US010208550B2

(12) United States Patent
Munshi et al.

(10) Patent No.: US 10,208,550 B2
(45) Date of Patent: Feb. 19, 2019

(54) ANCHORING DEVICE, SYSTEM AND METHOD OF ATTACHING AN ANCHOR TO A TUBULAR

(71) Applicants: Ammar A. Munshi, Sugar Land, TX (US); Keven M. O'Connor, Houston, TX (US); Jeffrey C. Williams, Cypress, TX (US)

(72) Inventors: Ammar A. Munshi, Sugar Land, TX (US); Keven M. O'Connor, Houston, TX (US); Jeffrey C. Williams, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 420 days.

(21) Appl. No.: 13/888,773

(22) Filed: May 7, 2013

(65) Prior Publication Data

US 2014/0334895 A1 Nov. 13, 2014

(51) Int. Cl.
*E21B 23/01* (2006.01)

(52) U.S. Cl.
CPC ..... *E21B 23/01* (2013.01)

(58) Field of Classification Search
CPC .... E21B 33/1208; E21B 33/128; E23B 23/01; E23B 23/103; F16B 7/14; F16B 7/1445; F16B 7/1463; F16B 7/149; Y10T 403/7049; Y10T 403/7052
USPC ..... 403/368; 166/384, 386, 387
See application file for complete search history.

(56) References Cited

U.S. PATENT DOCUMENTS

| | | | | |
|---|---|---|---|---|
| 2,970,651 | A * | 2/1961 | Roberts | E02D 5/805 166/120 |
| 4,702,635 | A * | 10/1987 | Muellenberg | F16D 1/093 29/426.6 |
| 5,542,473 | A * | 8/1996 | Pringle | 166/120 |
| 5,904,354 | A * | 5/1999 | Collins | 277/328 |
| 5,988,276 | A * | 11/1999 | Oneal | E21B 23/01 166/118 |
| 6,725,918 | B2 | 4/2004 | Gano | |
| 6,896,049 | B2 | 5/2005 | Moyes | |
| 7,017,669 | B2 * | 3/2006 | Johnston et al. | 166/382 |
| 7,117,949 | B2 * | 10/2006 | Doane et al. | 166/380 |
| 7,234,533 | B2 * | 6/2007 | Gambier | 166/387 |
| 7,347,274 | B2 * | 3/2008 | Patel et al. | 166/386 |
| 7,686,089 | B2 * | 3/2010 | Howlett et al. | 166/382 |

(Continued)

FOREIGN PATENT DOCUMENTS

WO 2009120759 A2 1/2009

OTHER PUBLICATIONS

Walvekar, S., and Jackson, T., "Expandable Technology Improves Reliability of Conventional Liner Hanger Systems"; Society of Petroleum Engineers; Conference Paper 99186-MS; IADC/SPE Drilling Conference, Feb. 21-23, 2006; pp. 1-11.

(Continued)

*Primary Examiner* — Joshua T Kennedy
(74) *Attorney, Agent, or Firm* — Cantor Colburn LLP

(57) ABSTRACT

An anchoring device includes at least one slip configured to fixedly engage the anchoring device to a structure when urged against the structure, and a member separate from the at least one slip positioned radially of the at least one slip having a portion that is radially deformable in response to longitudinal compression, the portion being configured to urge the at least one slip against the structure when deformed.

17 Claims, 5 Drawing Sheets

(56) References Cited

U.S. PATENT DOCUMENTS

| | | | | |
|---|---|---|---|---|
| 7,748,467 | B2 | 7/2010 | Doane | |
| 7,766,089 | B2 * | 8/2010 | Murray | 166/387 |
| 8,678,350 | B2 * | 3/2014 | Coull | 251/342 |
| 9,127,533 | B2 * | 9/2015 | Hallundbæk | E21B 33/1285 |
| 9,206,666 | B2 * | 12/2015 | Hallundbaæk | E21B 33/12 |
| 9,228,411 | B2 * | 1/2016 | Themig | E21B 33/1216 |
| 2003/0217844 | A1 * | 11/2003 | Moyes | 166/118 |
| 2005/0217869 | A1 * | 10/2005 | Doane et al. | 166/387 |
| 2008/0296845 | A1 | 12/2008 | Doane | |
| 2009/0242214 | A1 | 10/2009 | Foster et al. | |
| 2015/0013964 | A1 * | 1/2015 | Xu et al. | 166/135 |

OTHER PUBLICATIONS

Foran, E.V., "Pressure Completions of Wells in West Texas"; American Petroleum Institute; Conference Paper 34-048; Drilling and Production Practice, 1934; pp. 48-54.

* cited by examiner

ANCHORING DEVICE, SYSTEM AND METHOD OF ATTACHING AN ANCHOR TO A TUBULAR

BACKGROUND

Tubular anchoring devices such as those used in the carbon dioxide sequestration and hydrocarbon recovery industries typically employ slips that ramp along surfaces of cones to wedgedly engage with a tubular (such as a casing or liner) to which they are to be anchored. Although these systems serve the function for which they were designed, the slips and cones require annular space that could be used for other purposes, such as for flowing fluid or increasing the tubular wall thickness to increase strength. The industry is interested in alternate devices and methods for anchoring to tubulars that overcome this drawback and others associated with the current technology.

BRIEF DESCRIPTION

Disclosed herein is an anchoring device. The anchoring device includes at least one slip configured to fixedly engage the anchoring device to a structure when urged against the structure, and a member separate from the at least one slip positioned radially of the at least one slip having a portion that is radially deformable in response to longitudinal compression, the portion being configured to urge the at least one slip against the structure when deformed.

Further disclosed herein is a method of attaching an anchor to a tubular. The method includes compressing a member of an anchor longitudinally, deforming a portion of the member radially, moving at least one slip separate from the member radially with the deforming of the portion, compressing the at least one slip radially between the portion and an inner wall of the tubular, and attaching the anchor to the tubular.

Further disclosed herein is an anchoring system. The system includes a tubular, and an anchoring device having, at least one slip configured to fixedly engage the anchoring device to the tubular when urged against the tubular, and a member separate from the at least one slip positioned radially of the at least one slip having a portion that is radially deformable in response to longitudinal compression, the portion being configured to urge the at least one slip against the tubular when deformed.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
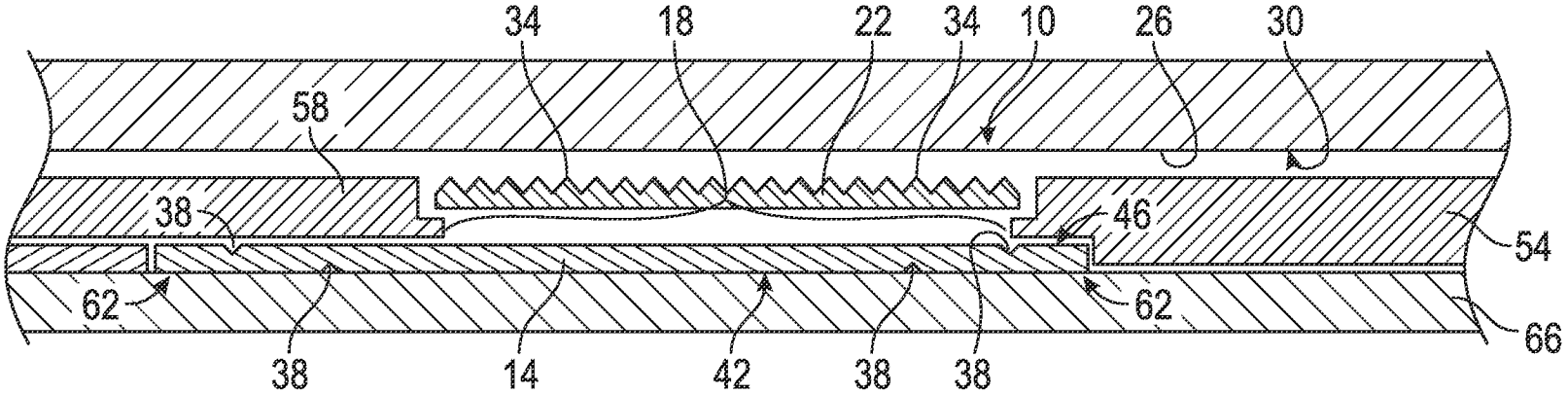
FIG. 1 depicts a partial cross sectional view of a tubular anchoring device disclosed herein in a non-anchoring position.

Referring to FIG. 1, an embodiment of an anchoring device disclosed herein is illustrated at 10. The anchoring device 10 includes at least one member 14, being a single member having a hollow cylindrical shape in this embodiment, having at least one portion 18 that is radially deformable in response to longitudinal compression of the member 14. The device 10 also has at least one slip 22, with the embodiment in these figures having a plurality of the slips 22. The slips 22 are radially compressible between the member 14 and a structure 26, illustrated herein as a tubular when the portion 18 is sufficiently deformed to press the slip 22 against the tubular 26. This urging force is normal to a wall 30 of the tubular 26 resulting in frictional engagement between the wall 30 and the slip 22, as will be described in greater detail hereunder, thereby fixing the anchoring device 10 to the tubular 26. The slips 22 may have teeth 34, as shown or other features to increase frictional engagement with the wall 30.

The member 14 is configured to deform radially in response to being longitudinally compressed. This embodiment includes radial grooves 38 in an inner surface 42 and/or an outer surface 46 of the member 14. Still other embodiments can include small radial displacements 50 (see FIG. 5) of the member 14 in the directions in which radial deformations are desired.

Figure 2:
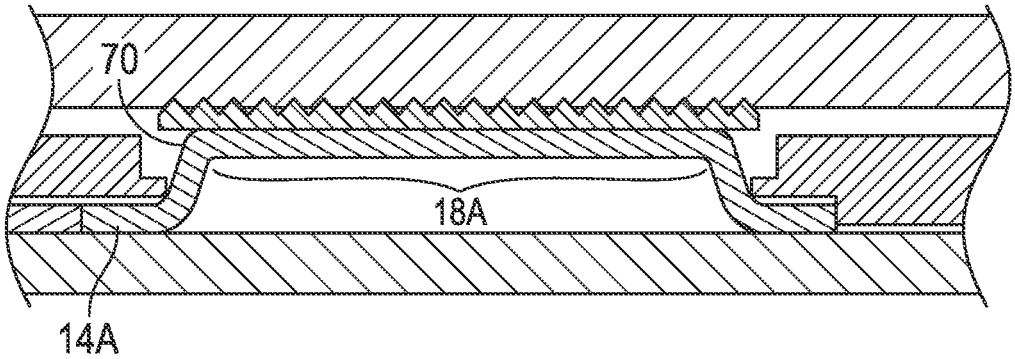
FIG. 2 depicts a partial cross sectional view of the tubular anchoring device of FIG. 1 in an anchoring position.

Referring to FIG. 2, the member 14A is shown in a deformed position urging the slips 22 against the wall 30 of the tubular 26. The member 14A has taken on the shape of an arch. The device 10 includes a collar 54 and a sleeve 58 on opposing longitudinal ends 62 of the member 14A to prevent the ends 62 from being longitudinally expanded. Since the ends 62 cannot longitudinally expand the arch shape of the member 14 assures the portion 18A is in compression by the radial force of the tubular 26 against the slips 22 and the portion 18A. One of the few ways that this configuration could fail would be through buckling of the portion 18A, but that would require very high forces in the member 14.

Figure 3:
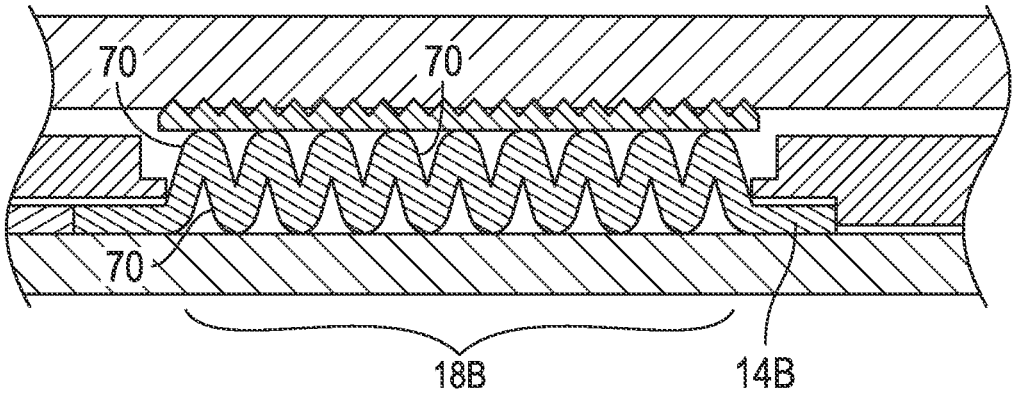
FIG. 3 depicts a partial cross sectional view of an alternate embodiment of the tubular anchoring device disclosed herein in an anchoring position.

Referring to FIG. 3, the member 14B overcomes the potential of buckling under loads described above by intentionally buckling the portion 18B of the member 14B during the deformation process such that it is undulating. In some embodiments the buckling is set to substantially fill the annular space defined radially between the slips 22 and a mandrel 66 (the mandrel 66 being radially inwardly of the member 14B). In so doing, there is essentially nowhere for the deformed portion 18B of the member 14B to go regardless of how high radial inward forces applied thereagainst become. Making the member 14B of an incompressible material, such as metal for example, prevents any elasticity of the deformation of the member 14B under load.

Figure 4:
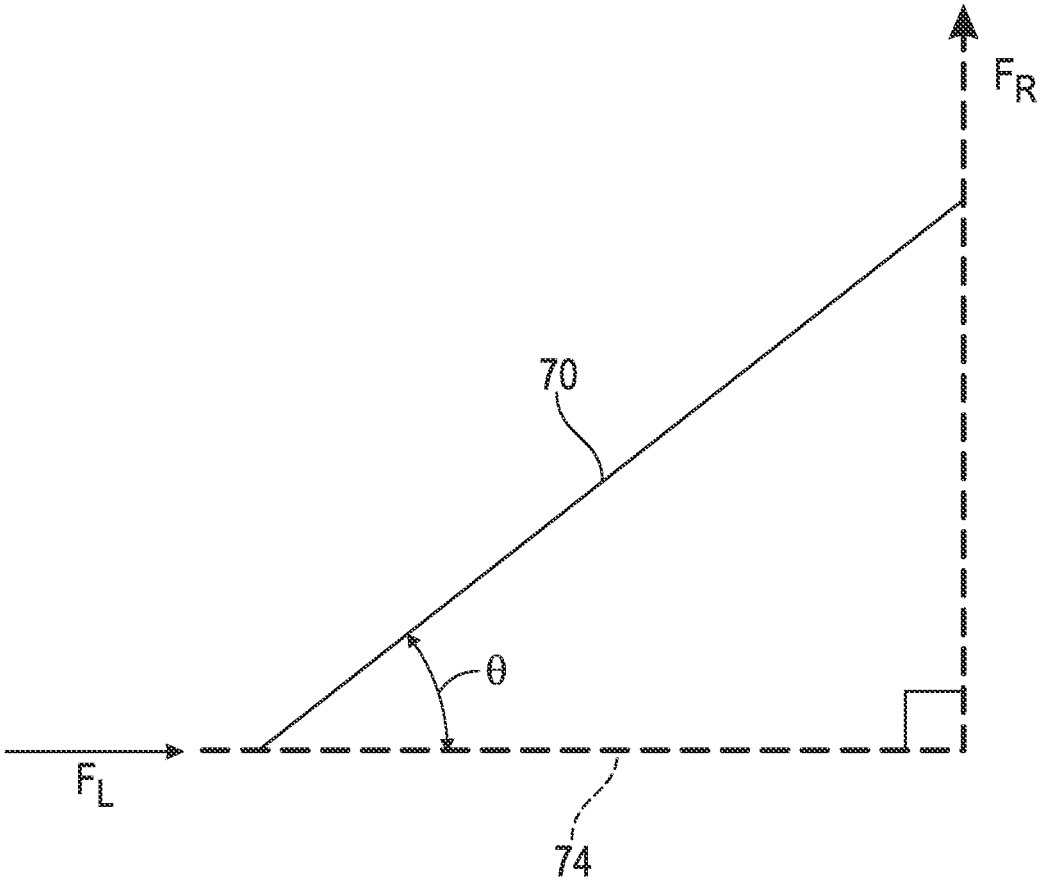
FIG. 4 depicts a force diagram of the tubular anchoring device of FIG. 3.

Embodiments of the device 10 have legs 70 that define the deformed portions 18A, 18B and form specific angles relative to an axis 74 of the device 10 when the portion 18A, 18B is fully deformed. The legs 70 effectively become wedged in the annular space between the slips 22 and the mandrel 66. This structure can be set to maintain desired radial loads between the slips 22 and the wall 30. Referring to FIG. 4, one of the legs 70 is shown in a force diagram. Θ represents the angle between the leg 70 and the axis 74. $F_R$ is the magnitude of the radial force and $F_L$ is the magnitude of the longitudinal force. If we let μ be the coefficient of friction between the slips 22 and the wall 30 then the following two equations hold:

$$\mathrm{Tan}(\theta) = \frac{F_R}{F_L} \tag{1}$$

$$\frac{F_R}{F_L} = \frac{1}{\mu} \tag{2}$$

Therefore:

$$\theta = \mathrm{Tan}^{-1}\left(\frac{1}{\mu}\right)$$

As an example, if we want the anchor to hold 10,000 lbs. longitudinally ($F_L$=10,000), and we know the slips 22 to wall 30 frictional coefficient is 0.4 (μ=0.4). Then the member 14 is configured so that when fully deformed forms an angle of Θ at least 68 degrees to support a radial force of 25,000 lbs. ($F_R$=25,000).

Figure 5:
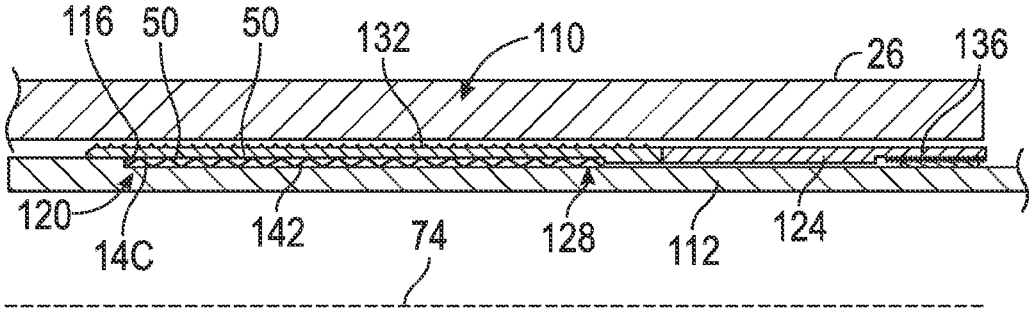
FIG. 5 depicts a partial cross sectional view of an alternate tubular anchoring device disclosed herein in a non-anchoring position.
Figure 6:
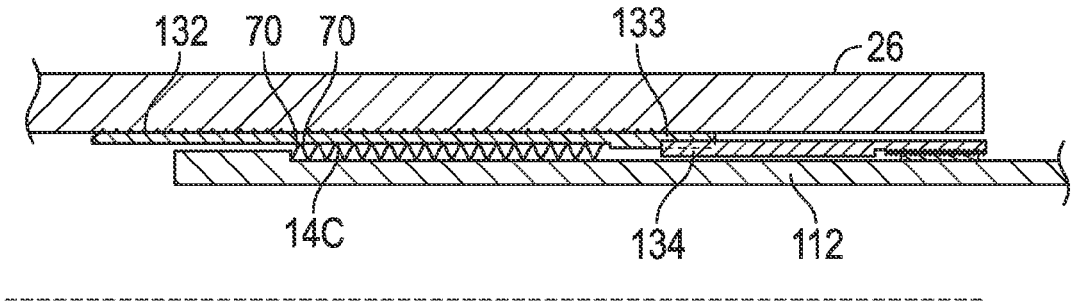
FIG. 6 depicts a partial cross sectional view of the tubular anchoring device of FIG. 5 in an anchoring position.

Referring to FIGS. 5 and 6, an alternate embodiment of an anchoring device is illustrated at 110. The device 110 has similarities to device 10 and thus only differences between the device 110 and the device 10 are described hereunder. The device 110 includes a mandrel 112 with a shoulder 116 thereon that engages with end 120 of the member 14C. A sleeve 124 engages with the other end 128 of the member 14C. The member 14C is radially deformable over its entire length. A slip 132 includes T-shaped bar 133 that engages within a T-shaped slot 134 in the sleeve 124 to carry longitudinal loads between the slip 132 and the sleeve 124. A latch 136 shown herein is a ratcheting device that allows the mandrel 112 to move relative to the sleeve 124 in a direction that longitudinally compresses the member 14C but prevents the mandrel 112 from moving in the opposing direction relative to the sleeve 124. This latch 136 maintains the member 14C in the deformed position once it has been deformed, thereby maintaining the slip 132 engagement with the tubular 26.

Embodiments of the members 14-14C disclosed herein, though not required, have perimetrically continuous walls 142. Being perimetrically continuous gives the walls 142 circumferential hoop strength that they would lack if the walls 142 were not continuous. The perimetrical continuous walls 142 also create a fluidic barrier. In applications wherein the ends 120, 128 and 62 are sealingly engaged with the mandrels 66, 112, collars 54 and sleeves 58, 124, for example, fluid can be prevented from flowing between the member 14-14C and any of the aforementioned components to which it is sealed.

Figure 7:
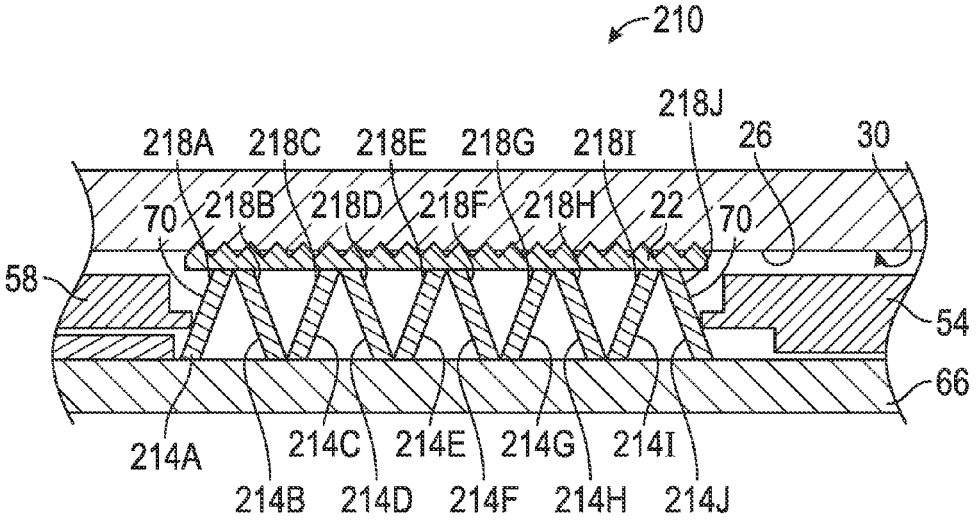
FIG. 7 depicts a partial cross sectional view of an alternate tubular anchoring device disclosed herein in an anchoring position.

Referring to FIG. 7, an alternate embodiment of an anchoring device disclosed herein is illustrated at 210. The anchoring device 210 employs members 214A-214J made of a plurality of conical spring washers, often referred to as Belleville washers that define a plurality of deformable portions 218A-218J. Each of the adjacent conical spring washers 214A-214J is oriented opposite to its neighbor. As such, longitudinal compression of the portions 218A-218J between the collar 54 and the sleeve 58 cause the portions 218A-218J to urge the slips 22 radially outwardly into anchoring engagement with the walls 30 of the tubular 26. The legs 70 of the portions 218A-218J are configured to meet the criteria discussed above.

Figure 8:
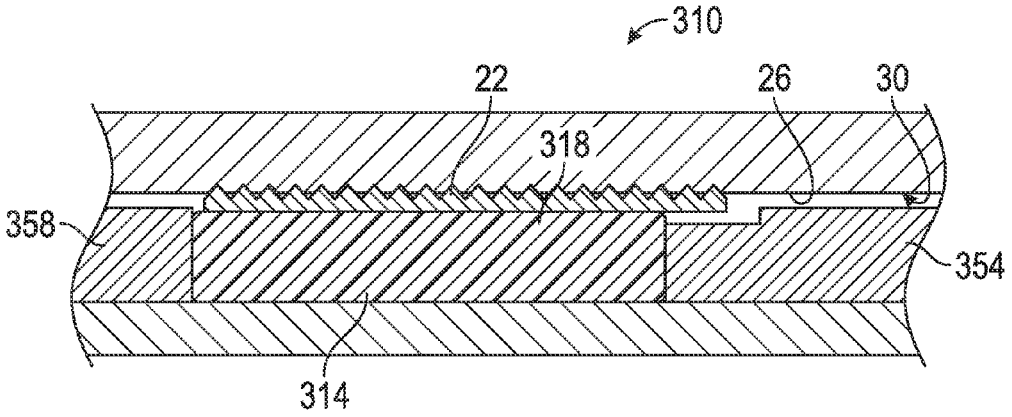
FIG. 8 depicts a partial cross sectional view of an alternate tubular anchoring device disclosed herein in an anchoring position.

Referring to FIG. 8, an alternate embodiment of an anchoring device disclosed herein is illustrated at 310. The anchoring device 310 employs a member 314 that has a deformable portion 318 that moves radially outwardly in response to longitudinal compression of the member 314. The member 314 is made of one or more materials that are substantially incompressible but is readily deformable when a load is applied thereto. Materials such as polymers, elastomers, and soft metal are well suited for this application. As such, when the member 314 is longitudinally compressed, such as between a collar 354 and a sleeve 358, it dimensionally shrinks longitudinally while dimensionally expanding radially. And since the mandrel 66 essentially prevents the member 314 from extending radially inwardly the radial expansion is primarily in a radial outward direction. The radial outward expansion of the member 314 urges the slips 22 radially outwardly into anchoring engagement with the walls 30 of the tubular 26. In still other embodiments the member 314 could be fluid filled bladder wherein the fluid is also substantially incompressible. Since the volume of the incompressible member 314 is constant, longitudinal compression of the member 314 necessarily causes it to expand radially.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An anchoring device comprising:

at least one slip configured to fixedly engage the anchoring device to a structure when urged against the structure, the at least one slip including a first end and a second end;

a sleeve having an end including a first recess portion;

a collar having an end portion including a second recess portion, wherein the at least one slip extends annularly about the anchoring device with the first end being arranged in the first recess portion and the second end being arranged in the second recess portion in a non-compressed state of the anchoring device, at least one of the first end and the second end being detached from at least one of the sleeve and the collar; and at least one member separate and distinct from the at least one slip positioned radially inwardly of and spaced from the at least one slip, the at least one member having at least one portion that is radially deformable in response to longitudinal compression between the collar and the sleeve, the at least one portion being configured to be the sole force to urge the at least one slip against the structure when deformed.

2. The anchoring device of claim 1, wherein the at least one member has a hollow cylindrical shape.

3. The anchoring device of claim 1, wherein the at least one member is perimetrically continuous.

4. The anchoring device of claim 1, wherein the at least one member includes a plurality of conical spring washers.

5. The anchoring device of claim 1, wherein a longitudinal cross section through the at least one member takes the form of an arch when the at least one portion is deformed.

6. The anchoring device of claim 1, wherein the at least one portion is configured to deform by buckling.

7. The anchoring device of claim 1, wherein a longitudinal cross section of the at least one portion when deformed is undulating.

8. The anchoring device of claim 1, wherein an angle defined between a leg of the at least one portion when deformed and an axis of the anchoring device is equal to the inverse tangent of the reciprocal of a coefficient of friction between the at least one slip and a wall of the structure.

9. The anchoring device of claim 1, wherein the at least one member is configured to cause the at least one portion to deform radially in response to longitudinal compression.

10. The anchoring device of claim 1, wherein the at least one member has lines of weakness to cause the at least one portion to deform radially in response to longitudinal compression.

11. The anchoring device of claim 1, further comprising a latching device configured to maintain the at least one portion in a deformed position.

12. The anchoring device of claim 1, wherein the at least one member is made of an incompressible material.

13. The anchoring device of claim 1, wherein the at least one slip includes a plurality of integrally formed teeth.

14. An anchoring system comprising:

a tubular; and an anchoring device comprising:

at least one slip configured to fixedly engage the anchoring device to the tubular when urged against the tubular, the at least one slip including a first end and a second end;

a sleeve having an end including a first recess portion;

a collar having an end portion including a second recess portion, wherein the at least one slip extends annularly about the anchoring device with the first end being arranged in the first recess portion and the second end being arranged in the second recess portion in a non-compressed state of the anchoring device, at least one of the first end and the second end being detached from at least one of the sleeve and the collar; and at least one member separate and distinct from the at least one slip positioned radially inwardly of and spaced from the at least one slip, the at least one member having at least one portion that is radially deformable in response to longitudinal compression between the collar and the sleeve, the at least one portion being configured to be the sole force to urge the at least one slip against the tubular when deformed.

15. The anchoring device of claim 1, further comprising a mandrel positioned radially of the at least one slip, the at least one member positioned annularly between the at least one slip and the mandrel having at least one leg configured to urge the at least one slip against the structure when wedged between the at least one slip and the mandrel.

16. The anchoring system according to claim 14, wherein the at least one slip includes a plurality of integrally formed teeth.

17. The anchoring system according to claim 14, further comprising:

wherein the collar is arranged radially inwardly of the tubular; and wherein the sleeve is arranged radially inwardly of the tubular spaced from the collar by a gap at which is positioned the at least one slip, wherein the at least one member is compressed against one of the collar and the sleeve and extends through the gap upon being radially deformed in response to the longitudinal compression.

* * * * *